United States Patent [19]

Ueda et al.

[11] Patent Number: 4,800,144

[45] Date of Patent: Jan. 24, 1989

[54] LAMINATED TYPE PHOTOSENSITIVE MEMBER FOR ELECTROPHOTOGRAPHY COMPRISING A SUBSTRATE OF ALUMITE

[75] Inventors: Hideaki Ueda, Kawanishi; Shizuo Yuge, Toyokawa; Katsutoshi Konishi, Toyono, all of Japan

[73] Assignee: Minolta Camera Kabushiki Kaisha, Osaka, Japan

[21] Appl. No.: 116,170

[22] Filed: Nov. 3, 1987

[30] Foreign Application Priority Data

| | | | |
|---|---|---|---|
| Nov. 4, 1986 | [JP] | Japan | 61-263488 |
| Nov. 4, 1986 | [JP] | Japan | 61-263489 |
| Nov. 4, 1986 | [JP] | Japan | 61-263490 |
| Nov. 4, 1986 | [JP] | Japan | 61-263491 |
| Nov. 4, 1986 | [JP] | Japan | 61-263492 |
| Nov. 4, 1986 | [JP] | Japan | 61-263493 |

[51] Int. Cl.[4] ..... G03G 5/10

[52] U.S. Cl. ..... 430/58; 430/65; 430/69; 204/58

[58] Field of Search ..... 430/69, 65, 58; 204/58

[56] References Cited

U.S. PATENT DOCUMENTS 4,675,089 6/1987 Long et al. ..... 204/164

FOREIGN PATENT DOCUMENTS 142241 11/1975 Japan .
219565 12/1983 Japan .
GB1446111 8/1976 United Kingdom .

*Primary Examiner*—J. David Welsh
*Attorney, Agent, or Firm*—Burns, Doane, Swecker & Mathis

[57] ABSTRACT

A laminated-type photosensitive member having an aluminum substrate, and a charge generating layer comprised of an organic pigment dispersed in resin, and a charge transporting layer, the aluminum substrate is anodized to form a alumite layer which has a certain thickness, a certain crystalline/amorphous aluminum oxide molar ratio, and a certain impedance; the anodized aluminum layer is sealed; and/or an undercoat layer is formed on the anodized layer. By such arrangement it is possible to obtain a laminated-type photosensitive member excellent in properties of photosensitive members, in particular, good anti-charge injection and retification characteristics.

4 Claims, No Drawings

LAMINATED TYPE PHOTOSENSITIVE MEMBER FOR ELECTROPHOTOGRAPHY COMPRISING A SUBSTRATE OF ALUMITE

BACKGROUND OF THE INVENTION

The present invention relates to a laminated type photosensitive member having at least a charge generating layer and a charge transport layer on an anodized aluminum substrate.

Hitherto, inorganic photoconductive materials, such as selenium, zinc oxide, titanium oxide, and cadmium sulfide, have been used as photosensitive materials for a photosensitive layer in photosensitive member used in electrophotography. However, these materials have a number of shortcomings as such a high degree of toxicity and a poor moisture resistance.

Photosensitive members consisting of photoconductive materials have advantages in respect to film-forming properties, lightweight properties, and cost performance, but on the other hand they have deficiencies in respect to sensitivity, durability, and stability to environmental changes.

Recently, a laminated type of photosensitive members in which its functions of charge generation and charge transport are separated has been proposed, whereby the difficulties with the earlier known photosensitive members using organic photoconductive materials have been substantially eliminated. As a result, organic photosensitive members have been put in practical use and, indeed, rapid advancement is seen today in this area of technology.

A laminated type photosensitive member includes a charge generating layer and a charge transporting layer on an electroconductive substrate made of metallic aluminum, copper, or the like.

The laminated type photosensitive members are required to satisfy various basic requirements, such as charge retainability, high sensitivity, repetition stability, resistance to insulation breakdown, wearing properties, durability, humidity resistance, transferability, cleaning properties, and preserving stability.

Further, laminated type photosensitive members are now used with laser printers as well, and for this purpose they are required to exhibit high image reliability in the process of reversal development, and good repetition stability.

In particular, a conventional binder-type photosensitive member with one layer can't be applied to reversal development on account of high residual potential, but a laminated photosensitive member can satisfy low residual potential.

Prior-art laminated type photosensitive members, in particular, those in which the charge generating layer is comprised of a dispersion film having a dispersed pigment in a resin, have had various deficiencies such as adhesive or coating properties to the substrate, and charge injection from a substrate into a charge transporting layer. Often, properties of the electroconductive substrate have a great bearing upon these problems. Therefore, improvements of the substrate and its charge injection properties and cladding characteristics are needed. As attempts to meet these requirements, photosensitive members incorporating an undercoat layer have been proposed in Japanese Patent Application KOKAI Nos. 30757/1983 and 95744/1983. Also, photosensitive members having an anodized aluminum substrate have been proposed in Japanese Patent Publication No. 30497/1978 and Japanese Patent Application KOKAI Nos. 14841/1983, 41360/1984, and 140947/1986.

However, any of the undercoat layers disclosed in Japanese Patent Application KOKAI Nos. 30757/1983 and 954744 1983 has a difficulty in that its electrical resistance is liable to be greatly influenced by changes in external environmental conditions, particularly, changes in atmospheric humidity, so that fogging may develop in low humidity conditions. If the electrical resistance of the undercoat layer is high, a static charge is applied to the layer, and such charge acts as so-called residual charge, thus causing a fog in images. An undercoat layer is required to meet various such characteristic requirements as above mentioned, but if it is formed of a single kind of resin, no satisfactory undercoat can be obtained. In view of this fact, the resin layer is constructed very thin, or electroconductive powdery materials (such as metallic powder) are dispersed in the resin if required. However, a thin resin layer provides the unsatisfactory performance as an undercoat layer, while an undercoat layer in which metallic powder are dispersed has a deficiency in that its surface characteristics are unsatisfactory because of the roughness of the metallic particles.

Where such prior art laminated type photosensitive members has been applied to a laser printer in particular, it has not been found successful because of very small black spots being produced in a white paper portion during the process of reversal development.

Japanese Patent Publication No. 30497/1978 discloses a photosensitive member having a free-cutting aluminum alloy substrate with an alumite layer formed thereon by anodizing. Japanese Patent Application KOKAI No. 14841/1983 discloses a photosensitive member formed by a process which includes immersing an aluminum substrate in a water bath having a specific resistance of not less than $10^{6}\Omega$cm and a temperature of not less than 60° C. Japanese Application KOKAI No. 41360/1984 discloses a photosensitive member having a phthalocyanine deposited film as a charge generating layer and an aluminum substrate so processed that an unsealed anodized film of 4 $\mu$m at least is formed thereon. Japanese Patent Application KOKAI No. 140947/1986 discloses a photosensitive member having a barrier layer and a porous layer formed on an aluminum substrate anodized prior to formation of an a—Si film on the aluminum surface. However, none of these publications contain any teaching on a solution to the problem of black spots produced during the process of reversal development in the case where the charge generation layer is comprised of a dispersion film, or on any relevant conditions.

SUMMARY OF THE INVENTION

It is an object of the present invention to provide a photosensitive member which eliminates aforesaid difficulties and has excellent electrophotographic characteristics, such as charge retaining properties, high sensitivity, repetition stability, resistance to insulation breakdown, wearing properties, durability, humidity resistance, transferability, cleaning properties, and preserving stability.

It is another object of the invention to provide a photosensitive member which is applicable for use in a laser printer and reversal-developable with high image reliability and good repetition stability.

DETAILED DESCRIPTION OF THE INVENTION

A photosensitive member in accordance with the invention comprises an aluminum substrate having an alumite layer, and a photosensitive layer formed thereon which consists at least of a charge generating layer and a charge transporting layer.

The alumite layer is an oxide layer formed by anodizing aluminum. An alumite layer suitable for the photosensitive member of the invention can be formed on the surface of an aluminum substrate, which has been processed to a columnar or other suitable configuration, by electrolysis in an electrolytic cell using sulfuric acid or oxalic acid as an electrolyte, with the aluminum substrate made anode. The alumite layer thus obtained consists of two layers, a barrier layer and a porous layer, formed on the substrate. The thickness of the barrier layer can be adjusted by regulating the electrolytic voltage, and the thickness of the porous layer can be adjusted by regulating the time of electrolysis. The alumite layer has a function of preventing charge injection, and to this end the barrier layer should be formed reasonably thick. However, the barrier layer with excessive thickness, results in a relatively high amount of residual potential, which may be a cause of lowered sensitivity and/or of fogging phenomenon in case of repeated use.

Therefore, the thickness of the barrier layer should be 100~1000 Å, and preferably 100~500 Å.

The porous layer should have a certain degree of thickness enough to provide good adhesion, but if it is excessively thick, it may result in increased residual potential, and/or increased dark current. Therefore, the thickness of the porous layer should be 1~15 μm, and preferably 2~10 μm, more preferably 2~8 μm.

The impedance of the alumite (anodized aluminum) layer should be regulated within the range of 1~200 KΩ, preferably 50 ~150 KΩ, whereby it is possible to minimize possibilities of deterioration in the characteristic features of the photosensitive member which may be attributable to the anodizing of the aluminum substrate, such as increased residual potential and lowered repeatability.

Such impedance adjustment can be effected by adjusting the time and voltage for electrolysis, or by sealing. If the impedance of the alumite layer is excessively low, the layer will not serve as an anti-injection layer; as a consequence, the charge retaining ability of the layer will be lowered and, in addition, a number of black spots are developed during the process of reversal development. Conversely, if the impedance of the alumite layer is excessively high, the initial residual potential will be high and the sensitivity will be lowered; in addition, repeated copying will result in increased residual potential and fog development in the images.

Impedance can be measured by the standard method of ASTM-B457-67, in which measurement is made by using an A-C impedance bridge. 35% salt water is used as an electrolyte and measurements are carried out at 1000 Hz. Tests are repeatedly made at different locations several times and a mean value of the measurements is taken as the impedance.

The impedance of the oxide layer is proportional to the thickness of the layer and inversely proportional to the area of measurement. Also, it is influenced by temperature conditions of measurement. The impedance of the alumite layer in the present invention is expressed in terms of impedance value under the conditions of: measurement area 0.129 $cm^2$ and measurement temperature 25° C.

Anti-charge injection properties are essential to a photosensitive having charge generating and charge transporting layers in particular. In the alumite layer there are formed a crystalline $Al_2O_3$ and an amorphous $Al_2O_3$. The crystalline $Al_2O_3$ is useful for preventing charge injection, while the amorphous $Al_2O_3$ is useful for improvement in bonding or adhesive properties. If the proportion of the crystalline $Al_2O_3$ having anti-charge injection properties is excessively large, the residual potential will increase, which in turn will cause deterioration in sensitivity and fog development in case of repeated use. A similar situation may be seen if the proportion of the amorphous $Al_2O_3$ is excessively large.

In view of this fact, the relative proportions of the crystalline $Al_2O_3$ and the amorphous $Al_2O_3$ should be such that the molar ratio of the amorphous $Al_2O_3$ to the crystalline $Al_2O_3$ is 50~1500 and preferably 100~1200, in which case most satisfactory performance will be obtained in photosensitive characteristics, image characteristics, and adhesive property.

A quantitative determination of the amorphous $Al_2O_3$ and the crystalline $Al_2O_3$ in the alumite layer can be obtained from the results of an X-ray diffraction test. The proportions of the amorphous $Al_2O_3$ and the crystalline $Al_2O_3$ can be adjusted by adjusting the following factors: electrolytic voltage, time of electrolysis, electrolytic density, and composition of electrolytic cell.

The anti-charge injection properties may also be largely influenced by impurities present in the alumite layer. If iron, copper, silicon, and the like are contained in the layer in relatively large quantities, the anticharge injection and rectification performance of the alumite layer may be considerably affected. In the present invention, it is desirable that impurities, such as silicon, copper, and iron, should be limited to as low a level as possible. The presence of magnesium and silicon may result in formation of a magnesium-silicon alloy which is very harmful. For these reasons, it is desirable that the content of these metals should be as small as practicable, but it is noted that if such metallic content is excessively small, the cuttability and workability of the aluminum substrate will be unfavorably affected.

From these points of view, it is desirable that the alumite layer should contain impurities to the following extent: less than 10% by weight of magnesium, less than 200 ppm of iron, less than 1% by weight of silicon, and 1% by weight in total of other metals. By allowing the presence of these metals to such extent it is possible to prevent the anti-charge injection properties from being unfavorably affected and to obtain satisfactory photosensitive characteristics, good image features, and good adhesivity.

The impurity content of the alumite layer in the present invention may be suitably adjusted according to the quality of the aluminum alloy and the conditions for anodizing.

Metals other than magnesium, iron, copper, and silicon, such as manganese, chromium, zinc, and titanium, may be contained in the alumite layer only if they do not act as a particular cause of charge injection, but the proportion of them is preferably be less than 0.1% by weight.

Quantities of metals present in the alumite layer can be determined by Auger electron spectroscopic analysis and emission spectroscopic analysis.

From the standpoint of rectification property improvement, the alumite layer in the invention should preferably be sealed. Sealing can be effected by treating the alumite layer in an aqueous solution of nickel acetate (nickel acetate method) after the alumite layer has been formed. Some other sealing method, such as for example water vapor method, is known, but if an alumite layer subjected to such way of sealing is used in forming a photosensitive member, the rectification property of the layer is lost, with the result of considerable increase in residual potential.

For the purpose of sealing, the concentration of nickel acetate is preferably 1~15 wt%, more preferably 5~10 wt%. The temperature of the aqueous nickel acetate solution is preferably 50~80° C.

Further, it is desirable that sealing should be effected in part. The expression "in part" means that the surface only is sealed of the porous layer in which hollows are present. The degree of sealing may be adjusted by regulating the sealing time, the nickel acetate concentration, and the temperature of the solution. Electron inflow is smoothly effected with the help of the impurities, such as Ni and the like, incorporated into the alumite layer as a result of partial sealing, while injection of holes is prevented by the barrier characteristics of the alumite layer; thus, satisfactory rectification property can be obtained.

In order to ensure more complete attainment of such performance characteristics as anti-charge injection and rectification properties which are required of a photosensitive member, it is useful to provide an undercoat layer on the alumite layer. The undercoat layer may be resin only, electroconductive particles-dispersed resin or a metallized layer of inorganic materials.

For provision of the undercoat layer, such resins as casein, polyvinyl alcohol, nitrocellulose, ethyleneacrylate copolymer, polyamide, copolymer nylon, polyimide, polyurethane, and gelatin are used. Electroconductive materials include metallic particles such as Al, Ag, Cu, Ni, Au and Bi, electroconductive metallic oxide such as tin oxide, indium oxide and zinc oxide or carbon etc. Deposited films, such as aluminum oxide, silicon oxide, and titanium oxide, may also be used.

Such undercoat layer is formed to the thickness of 0.01~5 82 m. In the present invention, even such thin layer of as thin as 0.01~0.1 μm, which is usually considered to be of little effect, is useful.

Organic pigments useful for the charge generation layer in the invention are azo pigments, perylene pigments, phthalocyanine pigments, polycyclic quinone pigments, indigo pigments, and quinacridone pigments.

A charge generating layer can be obtained by coating to a thickness of 0.1~1 μm of a solution prepared by dissolving a binder resin in a suitable solvent, adding 10~200 parts by weight of aforesaid pigment relative to 100 parts by weight of the binder resin, and dispersing the mixture by means of a ball mill, oscillating mill, sand mill, or roll mill.

A charge transporting layer can be obtained by coating to a thickness of 5~30 μm of a solution prepared by dissolving any of such substances having a charge transporting capability as electron donors, such as derivatives of pyrazoline, triphenylmethane, oxadiazole, carbazole, hydrazone, styryl, and imidazole, or electron receptors, such as trinitrofluorenone, tetracyanoethylene, and tetracyanoquinodimethane in a film-forming resin.

Binder resins useful for the charge generating and charge transporting layers are polyester, polycarbonate, polymethacrylate, polyvinylbutyral, silicone resin, epoxy resin, urethane resin, and polystyrene.

An photosensitive member of the present invention may comprise an anodized aluminum substrate on which charge generating layer, and a charge transporting layer are laminated in the order, or a charge transporting layer, and a charge generating layer are laminated in the order. Further, in either case, the photosensitive member may have a surface protection layer or an intermediate layer as required. Of course, as earlier mentioned, an undercoat layer may be formed on the alumite layer.

Hereinbelow, examples are given to further illustrate the invention. In the following examples, unless otherwise specified, "parts" means "parts by weight."

EXAMPLE 1

An aluminum plate the surface of which was lathe-processed was used as an electroconductive substrate. An anodized aluminum layer (alumite layer) was formed on the substrate surface in an electrolytic cell having 15 vol% of sulfuric acid at 20° C.±1° C. Impedance value was measured by using Twin City Z-Scope in accordance with ASTM-B457-67.

Nextly, for formation of a charge generating layer thereon, one part of a bisazo pigment expressed by the following general formula, one part of polyester resin ("Bylon 200", produced by Toyobo Co.), and 90 parts of cyclohexanone were placed in a sand grinder and treated therein for dispersion, and thereafter the dispersion was coated over the substrate to form a generating layer having a thickness of 0.5 μm.

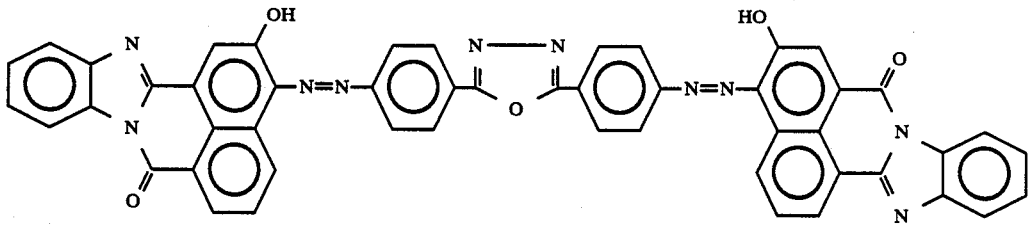

On this charge generatig layer, an charge transporting layer is formed to prepare a photosensitive member by coating a solution prepared by dissolving 10 parts of a hydrazone compound expressed by the following formula;

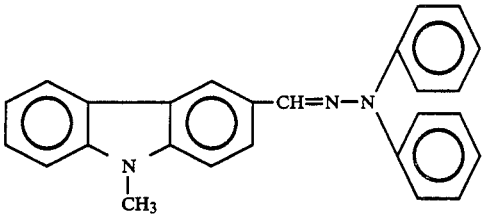

and 10 parts of polycarbonate resin ("Panlite K 1300", produced by Teijin Ltd.) in 100 parts of tetrahydrofuran so that a post-dryed layer thickness of 15 μm would be obtained.

EXAMPLE 2~4

Alumite layers having the characteristics shown in Table 1 were formed in s similar way as in Example 1. on each of the alumite layers was formed a charge generating layer and a charge transporting layer in a similar way as in Example 1 to prepare photosensitive members.

Comparative Examples 1~2

Photosensitive members were prepared in the same way as in Example 1, except that an alumite layer having the characteristics shown in Table 1 was provided.

Comparative Example 3

A photosensitive member was prepared in the same way as in Example 1, except that a non-anodized aluminum substrate was used. The aluminum substrate had an impedance value of 0.01 KΩ.

EXAMPLE 5

An alumite layer with the properties shown in Table 1 was formed in a similar way as Example 1.

Nextly, for formation of a charge generating layer on the substrate, 1 part of metal-free phthalocyanine (produced by Toyo Ink Co.), 1 part of polystyrene, and 50 parts of cyclohexanone were poured into a ball mill pot and the mixture was dispersed for 24 hrs. and a photosensitive coating solution was thus obtained; the solution was coated on the substrate, then dried. Thus, a charge generation layer having a thickness of 0.5 μm was obtained. On this charge generating layer, an charge transporting layer is formed to prepare a photosensitive member by coating a solution prepared by dissolving 10 parts of a compound expressed by the following formula;

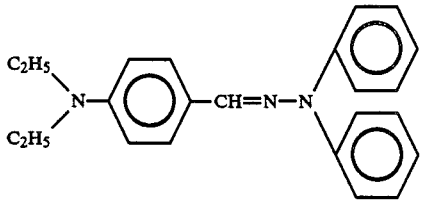

and 10 parts of polycarbonate resin in 100 pats of tetrahydrofuran so that a post-dryed layer thickness of 15 μm could be obtained.

EXAMPLES 6~7

An alumite layer with the properties shown in Table 1 was formed in a similar way as Example 5. A charge generating layer and a charge transporting layer were formed on the alumite layer in a similar way as Example 5 to obtain a photosensitive member.

EXAMPLE 8

An alumite layer with the properties shown in Table 1 was formed in a similar way as Example 1.

Nextly, for formation of a charge generating layer on the substrate, 1 part of metal-free phthalocyanine (produced by Toyo Ink Co.), 1 part of polystyrene, and 50 parts of cyclohexanone were poured into a ball mill pot and the mixture was dispersed for 24 hrs. and a photosensitive coating solution was thus obtained; the solution was coated on the substrate, then dried. Thus, a charge generation layer having a thickness of 0.3 μm was obtained. On this charge generating layer, an charge transporting layer is formed to prepare a photosensitive member by coating a solution prepared by dissolving 10 parts of a compound expressed by the following formula;

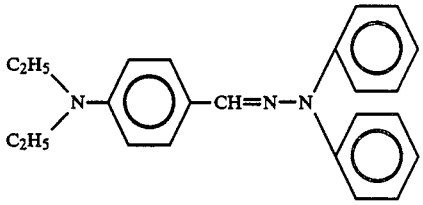

and 10 parts of polycarbonate resin in 100 parts of tetrahydrofuran so that a post-dried layer thickness of 15 μm could be obtained.

Comparative examples 4~6

Photosensitive members were prepared in the same way as Example 8, except that an alumite layer with the properties shown in Table 1 was formed.

EXAMPLE 9

An alumite layer with the properties shown in Table 1 was formed. An undercoat layer of 0.1 μm in thickness was formed on the alumite layer by coating the solution of 1% of phenol resin in ethanol.

On the undercoat layer, an charge generating layer and an charge transporting layer were formed in the same way as Example 1 to prepare an photosensitive member.

EXAMPLE 10

An alumite layer with the properties shown in Table 1 was formed in a similar way as example 1. Subsequently, the alumite layer was subjected to sealing treatment in an aqueous solution of nickel acetate (concentration 7 wt%) at 50° C.

Nextly, for formation of a charge generating layer on the substrate, 1 part of titanylphthalocyanine, 1 part of polystyrene, and 50 parts of cyclohexanone were put into a ball mill pot and the mixture was dispersed for 24 hours and a photosensitive coating solution was obtained; the solution was coated on the substrate, then dried. Thus, a charge generating layer having a thickness of 0.3 μm was obtained.

Then, on this charge generating layer, an charge transporting layer is formed to prepare a photosensitive member by coating a solution prepared by dissolving 10 parts of a compound expressed by the general formula;

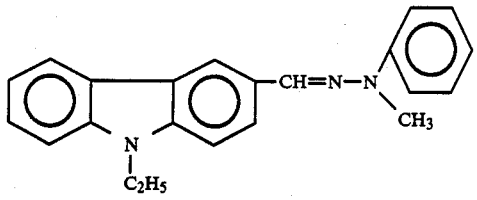

and 10 parts of policarbonate resin in 100 parts of tetrahydrofuran so that a post-dried layer thickness of 15 μm could be obtained.

EXAMPLES 11~13

An alumite layer with the properties shown in Table 1 was formed in a similar way as Example 10 and the alumite layers were treated with nickel acetate for sealing as in Example 10. On the alumite layer, a charge generating layer and a charge transporting layer were formed in a similar way as Example 10 to prepare an photosensitive member.

Comparative Examples 7~8

An alumite layer with the properties shown in Table 1 was formed and the alumite layers were treated with nickel acetate for sealing in a similar way as Example 10. On the alumite layer, a charge generating layer and a charge transporting layer were formed in a similar way as Example 1 to prepare an photosensitive member.

TABLE 1

| | layer thickness (μ) | barrier layer thickness (A) | porous layer thickness (μ) | amorphous/ crystalline | impedance (KΩ) | impurity concentration in alumite layer (wt %) Mg | Cu | Fe (PPM) | Si |
|---|---|---|---|---|---|---|---|---|---|
| Example 1 | 6 | 300 | 6 | 190 | 60 | 0.4 | 0.01 | trace | 0.05 |
| Example 2 | 2 | 120 | 2 | 150 | 10 | 0.3 | 0.01 | 100 | 0.2 |
| Example 3 | 8 | 200 | 8 | 390 | 112 | 1.0 | 0.02 | 50 | 0.2 |
| Example 4 | 10 | 350 | 10 | 290 | 174 | 0.6 | 0.01 | trace | 0.3 |
| Comparative 1 | 0.5 | 80 | 0.5 | 6 | 0.4 | 0.5 | 0.01 | 150 | 0.3 |
| Comparative 2 | 21 | 1500 | 21 | 12 | 30 | 1.0 | 0.1 | 100 | 0.3 |
| Comparative 3 | — | — | — | — | 0.01 | — | — | — | — |
| Example 5 | 8 | 180 | 8 | 400 | 24 | 0.5 | 0.04 | 100 | 0.1 |
| Example 6 | 15 | 300 | 15 | 450 | 120 | | | | |
| Example 7 | 7 | 800 | 7 | 80 | 10 | | | | |
| Example 8 | 13 | 110 | 13 | 1200 | 40 | | | | |
| Comparative 4 | 0.5 | 200 | 0.5 | 28 | 2.6 | | | | |
| Comparative 5 | 20 | 90 | 20 | 1850 | 240 | | | | |
| Comparative 6 | 0.5 | 5 | 0.5 | 1670 | 0.7 | | | | |
| Example 9 | 4 | 300 | 4 | 120 | 30 | 0.3 | 0.02 | trace | 0.05 |
| Example 10 | 7 | 200 | 7 | 320 | 25 | | | | |
| Example 11 | 9 | 300 | 9 | 280 | 140 | | | | |
| Example 12 | 6 | 100 | 6 | 500 | 107 | | | | |
| Example 13 | 10 | 500 | 10 | 190 | 180 | | | | |
| Comparative 7 | 2 | 15 | 2 | 1200 | 0.6 | | | | |
| Comparative 8 | 13 | 1200 | 13 | 100 | 310 | | | | |

In a powder-image transfer type copying machine (EP 470Z, made by Minolta Camera Co.), each of the resultant photosensitive members was corona-charged and subjected to measurement on the following items: quantity of exposure $E\frac{1}{2}$(lux·sec) required in reducing the initial potential to ½ where the initial surface potential ($V_0$) was at −750 V; rate of decay $DDR_5$ (%) of the initial potential when the photosensitive member was allowed to stand in a dark place for 5 sec; and residual potential Vr (V).

Measurements were also made with respect to black spots in wiite portions and white spots in black portions when reversal-developed at $V_0 = -750$ V, development bias Vb = −500 V. Results are shown in Table 2, in which ◎ denotes excellent ○ good, X questionable, and XX very bad.

TABLE 2

| | E ½ (lux · sec) | $DDR_5$ (%) | $V_R$ (V) | reversal-development black spot | reversal-development white spot |
|---|---|---|---|---|---|
| Example 1 | 2.2 | 11.5 | 7 | ◎ | ○ |
| Example 2 | 2.0 | 12.3 | 8 | ○ | ○ |
| Example 3 | 2.1 | 12.0 | 9 | ◎ | ○ |
| Example 4 | 2.2 | 11.0 | 12 | ○ | ○ |
| Comparative 1 | 2.1 | 15.0 | 6 | X | ○ |
| Comparative 2 | 3.0 | 11.0 | 43 | ○ | X |
| Comparative 3 | 2.3 | 14.0 | 8 | XX | X |
| Example 5 | 1.2 | 28.0 | 5 | ○ | ○ |
| Example 6 | 1.2 | 27.0 | 13 | ◎ | ○ |
| Example 7 | 1.2 | 29.0 | 15 | ○ | ○ |
| Example 8 | 1.5 | 23.0 | 7 | ○ | ○ |
| Comparative 4 | 1.8 | 24.0 | 17 | X | ○ |
| Comparative 5 | 3.3 | 25.5 | 54 | ○ | X |
| Comparative 6 | 1.5 | 26.0 | 8 | X | ○ |
| Example 9 | 2.2 | 12.0 | 10 | ○ | ○ |
| Example 10 | 0.8 | 17.0 | 6 | ○ | ○ |
| Example 11 | 0.8 | 16.5 | 7 | ◎ | ○ |
| Example 12 | 0.9 | 18.0 | 8 | ◎ | ○ |
| Example 13 | 0.8 | 16.0 | 10 | ○ | ○ |
| Comparative 7 | 2.2 | 11.8 | 7 | X | ○ |
| Comparative 8 | 3.3 | 10.4 | 51 | ○ | X |

What is claimed is:

1. A photosensitive member having at least a charge generating layer and a charge transporting layer on an aluminum substrate, wherein the charge generating layer is an organic pigment-dispersed resin layer, the aluminium substrate comprises an alumite layer, and the alumite layer has impedance of 1~200 KΩ and molar ratio of amorphous aluminum oxide to crystalline aluminum oxide of 50~1500.

2. A photosensitive member of the claim 1, wherein the alumite layer comprises a barrier layer of 100~1000Å in thickness and a porous layer of 1~15 μm in thickness.

3. A photosensitive member of the claim 1, wherein an undercoat layer is formed on the alumite layer.

4. A photosensitive member having at least a charge generating layer and a charge transporting layer on an aluminum substrate, wherein the charge generating layer is an organic pigment-dispersed resin layer, the aluminum substrate comprises an alumite layer which is an anodized aluminum layer and subjected to a sealing treatment by the nickel acetate method, and the alumite layer has impedance of 1~200 KΩ, and molar ratio of amorphous aluminum oxide to crystalline aluminum oxide of 50~1500.

* * * * *